US008863424B2

(12) United States Patent
Simmons et al.

(10) Patent No.: US 8,863,424 B2
(45) Date of Patent: Oct. 21, 2014

(54) SEAR FOR CONVERTING A PULL TRIGGER INTO A RELEASE TRIGGER

(75) Inventors: David A. Simmons, New Philadelphia, OH (US); Patrick M. McCarthy, Dalton, OH (US)

(73) Assignee: Extreme Shooting Products Ltd, New Philadelphia, OH (US)

( * ) Notice: Subject to any disclaimer, the term of this patent is extended or adjusted under 35 U.S.C. 154(b) by 195 days.

(21) Appl. No.: 13/412,072

(22) Filed: Mar. 5, 2012

(65) Prior Publication Data

US 2012/0227301 A1 Sep. 13, 2012

Related U.S. Application Data

(60) Provisional application No. 61/450,478, filed on Mar. 8, 2011.

(51) Int. Cl.

| | |
|---|---|
| ***F41A 19/00*** | (2006.01) |
| ***F41A 19/24*** | (2006.01) |
| ***F41A 19/12*** | (2006.01) |
| ***F41A 19/10*** | (2006.01) |

(52) U.S. Cl.

CPC ..... *F41A 19/12* (2013.01); *F41A 19/24* (2013.01); *F41A 19/10* (2013.01)

USPC ..... 42/69.01; 42/69.02

(58) Field of Classification Search

CPC ..... F41A 19/10; F41A 19/12; F41A 19/24; F41A 19/25

USPC ..... 42/69.01, 69.02, 69.03, 41, 42.01

See application file for complete search history.

(56) References Cited

U.S. PATENT DOCUMENTS

| | | | | | |
|---|---|---|---|---|---|
| 2,027,950 | A | * | 1/1936 | Young | 42/69.03 |
| 2,033,803 | A | * | 3/1936 | Anderson | 42/69.01 |
| 2,079,039 | A | * | 5/1937 | Rush | 42/69.03 |
| 2,136,511 | A | * | 11/1938 | Jones | 42/69.01 |
| 2,233,504 | A | * | 3/1941 | Young | 42/69.03 |
| 2,406,980 | A | * | 9/1946 | Young | 42/69.01 |
| 2,406,981 | A | * | 9/1946 | Young | 42/69.01 |
| 2,626,476 | A | * | 1/1953 | Miller | 42/69.03 |
| 2,654,175 | A | * | 10/1953 | Hansen | 42/69.03 |
| 3,389,488 | A | * | 6/1968 | Beretta | 42/42.01 |
| 3,791,061 | A | * | 2/1974 | Tirone | 42/41 |
| 3,808,724 | A | * | 5/1974 | Linde | 42/42.01 |
| 3,983,654 | A | * | 10/1976 | Vironda | 42/69.01 |
| 4,026,056 | A | * | 5/1977 | Roman | 42/69.01 |
| 4,328,635 | A | * | 5/1982 | Klavestad | 42/12 |
| 4,380,881 | A | * | 4/1983 | Klavestad | 42/42.01 |
| 4,545,143 | A | * | 10/1985 | Schultz | 42/42.01 |
| 6,460,281 | B1 | * | 10/2002 | Schaeffer | 42/42.01 |
| 2004/0020094 | A1 | * | 2/2004 | Ealovega | 42/69.03 |
| 2009/0188145 | A1 | * | 7/2009 | Fluhr et al. | 42/69.01 |
| 2010/0281739 | A1 | * | 11/2010 | Geissele | 42/69.01 |

* cited by examiner

*Primary Examiner* — Michelle R Clement

(74) *Attorney, Agent, or Firm* — Zollinger & Burleson Ltd.

(57) ABSTRACT

A sear for a shotgun trigger assembly is used to convert a pull trigger to a release trigger. The release trigger sear includes a second catch surface that holds the striker catch until the trigger is released. The sear having the second catch surface may be retrofit into an existing pull trigger assembly to convert the pull trigger assembly to a release trigger assembly without further modifications to the trigger assembly. The disclosure also provides a release trigger having an assembly that adjusts the pull and release weights of the trigger.

20 Claims, 5 Drawing Sheets

SEAR FOR CONVERTING A PULL TRIGGER INTO A RELEASE TRIGGER

CROSS REFERENCE TO RELATED APPLICATIONS

This application claims the benefit of U.S. Provisional Application 61/450,478 filed Mar. 8, 2011; the disclosures of which are incorporated herein by reference.

BACKGROUND OF THE INVENTION

1. Technical Field

The invention generally relates to shotgun triggers and, more particularly, to release triggers used with shotguns used to shoot trap. Specifically, the invention relates to a sear configuration that allows a pull trigger to be converted into a release trigger that is particularly useful for trap shooting.

2. Background Information

A shotgun trigger assembly is the mechanism that actuates the firing of the shotgun's shell. A shotgun trigger assembly typically includes a lever or trigger that is pulled by a user's finger. Most shotgun triggers actuate a striking device when the trigger is pulled back toward the user. The striking device may be a pivoting hammer or an axially-driven striker. The striking device drives a firing pin into a primer carried by the shell. The primer explodes thereby firing the powder in the shell.

Trap shooting is one of the three major forms of competitive clay pigeon shooting wherein a shotgun is used to break clay pigeons. In trap shooting, the clay pigeons travel away from the shooter. Tracking such targets frequently requires the shooter to sweep the shotgun downwardly. A traditional pull trigger can be a drawback when shooting trap because the natural pulling motion on a pull trigger tends to pull the end of the shotgun upwardly thus countering the desired downwardly sweeping direction frequently used by a trap shooter. Some trap shooters thus use a shotgun equipped with a release trigger. A release trigger actuates the striking device when the trigger is released by the shooter's finger (after first being pulled back), rather than when the trigger is pulled by the shooter. A release trigger does not impede the downward movement of the shotgun and thus may improve a trap shooter's chance of breaking the target.

In some shotgun trigger mechanisms, the structure that operatively connects a trigger and a striker is known as a sear. Some shotgun owners with pull triggers desire a solution for converting their pull trigger to a release trigger. One exemplary shotgun trigger assembly is currently sold in a Blazer F3 shotgun. This trigger assembly includes a sear that holds a striker catch. Pulling the trigger back actuates the sear to release the striker catch which, in turn, releases the striker to fire the gun.

SUMMARY OF THE DISCLOSURE

The disclosure provides a sear that converts a pull trigger to a release trigger. The release trigger sear includes a second holding surface in addition to the first holding surface. The second holding surface holds the striker catch until the trigger is released thus allowing the trigger to operate as a release trigger.

The disclosure provides a replacement for an existing trigger sear that converts the trigger to a release trigger without requiring additional modifications to the trigger assembly.

The disclosure also provides a release trigger assembly having a pressure adjustment assembly that is used to adjust the pull and release weights of the trigger.

In one configuration, the disclosure provides a sear for converting a pull trigger for a shotgun into a release trigger; wherein the sear includes: a body that defines a first catch surface disposed adjacent to and below a second catch surface; the first catch surface being adapted to hold a striker catch before the trigger is pulled back and the second catch surface being adapted to hold the striker catch until the holding pressure on the trigger is released.

The disclosure also provides a method for converting a pull trigger to a release trigger wherein the pull trigger includes a rear lifting block; a pull trigger sear that is engaged by the rear lifting block when the trigger is pulled rearwardly; a striker catch engaging a first catch surface of the sear; the striker catch retaining a biased striker that is used to drive a firing pin into a primer; the method including the step of: replacing the pull trigger sear with a release trigger sear that has a second catch surface disposed adjacent the first catch surface; the striker catch being adapted to engage the second catch surface of the sear to prevent the striker from being released until the trigger is released by the user.

The disclosure further provides a release trigger assembly for a shotgun having a trigger with a rear lifting block; a sear that is engaged by the rear lifting block when the trigger is pulled rearwardly; a striker catch engaging a first catch surface of the sear; the striker catch retaining a biased striker that is used to drive a firing pin into a primer; the improvement characterized in that: the sear having a second catch surface disposed adjacent the first catch surface; the striker catch being adapted to engage the second catch surface of the sear to prevent the striker from being released until the trigger is released by the user.

BRIEF DESCRIPTION OF THE DRAWINGS

The drawings are not to scale. Similar numbers refer to similar parts throughout the specification.

DETAILED DESCRIPTION OF THE DISCLOSURE

Figure 1:
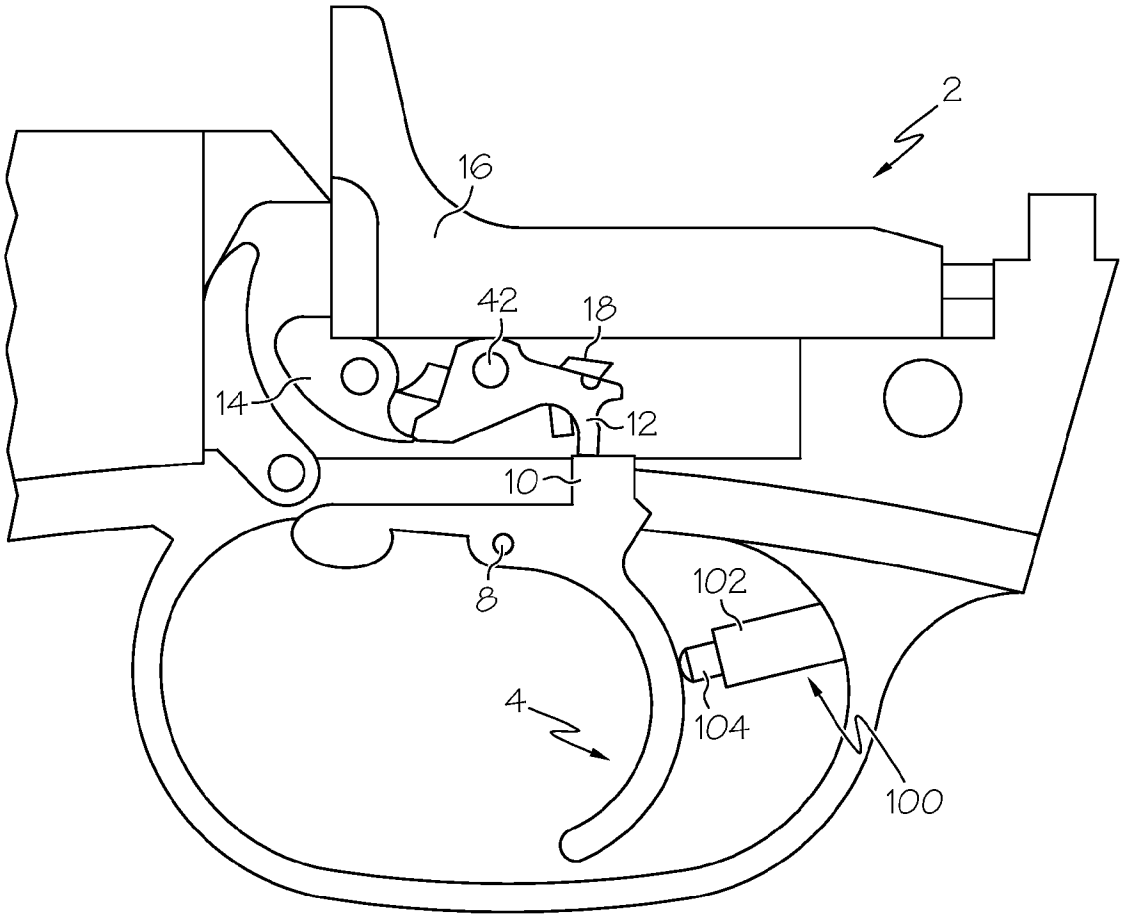
FIG. 1 is a side view of the trigger assembly showing the home position.

A release trigger assembly using the sear described herein is indicated generally by the reference numeral 2 in the accompanying drawings. Only the left side (when viewed from above and behind the gun) of trigger assembly is depicted in the drawings. A double barrel shotgun that has two firing pins uses duplicate parts of trigger assembly on the right side of trigger assembly 2. Trigger assembly 2 includes a mechanism that moves the trigger 4 back and forth between the left and right hand side of trigger assembly 4 each time trigger 4 is pulled and released. The following description of the operation applies to both the left and right hand sides of trigger assembly 2.

Trigger assembly 2 generally includes trigger 4 disposed within a trigger guard 6. Trigger 4 is pivotably mounted between a home position and a set position on a trigger pin 8 that causes a rear lifting block 10 of trigger 4 to move upwardly (the upward direction being toward the top of the page of FIG. 1) with respect to trigger assembly 2 when trigger 4 is pulled rearwardly. Rear lifting block 10 may be a protrusion or just a portion of trigger 4. Trigger assembly 2 further includes a sear 12 that is moved by trigger 4 to actuate a striker catch 14. Striker catch 14 "catches" or holds a striker assembly 16 against the force of the striker spring (not shown) until striker catch 14 is released. A sear catch 18 is operatively connected to trigger 4 and is used to hold sear 12 in the set position. Various springs are used to urge these elements back to their home positions.

Figure 4:
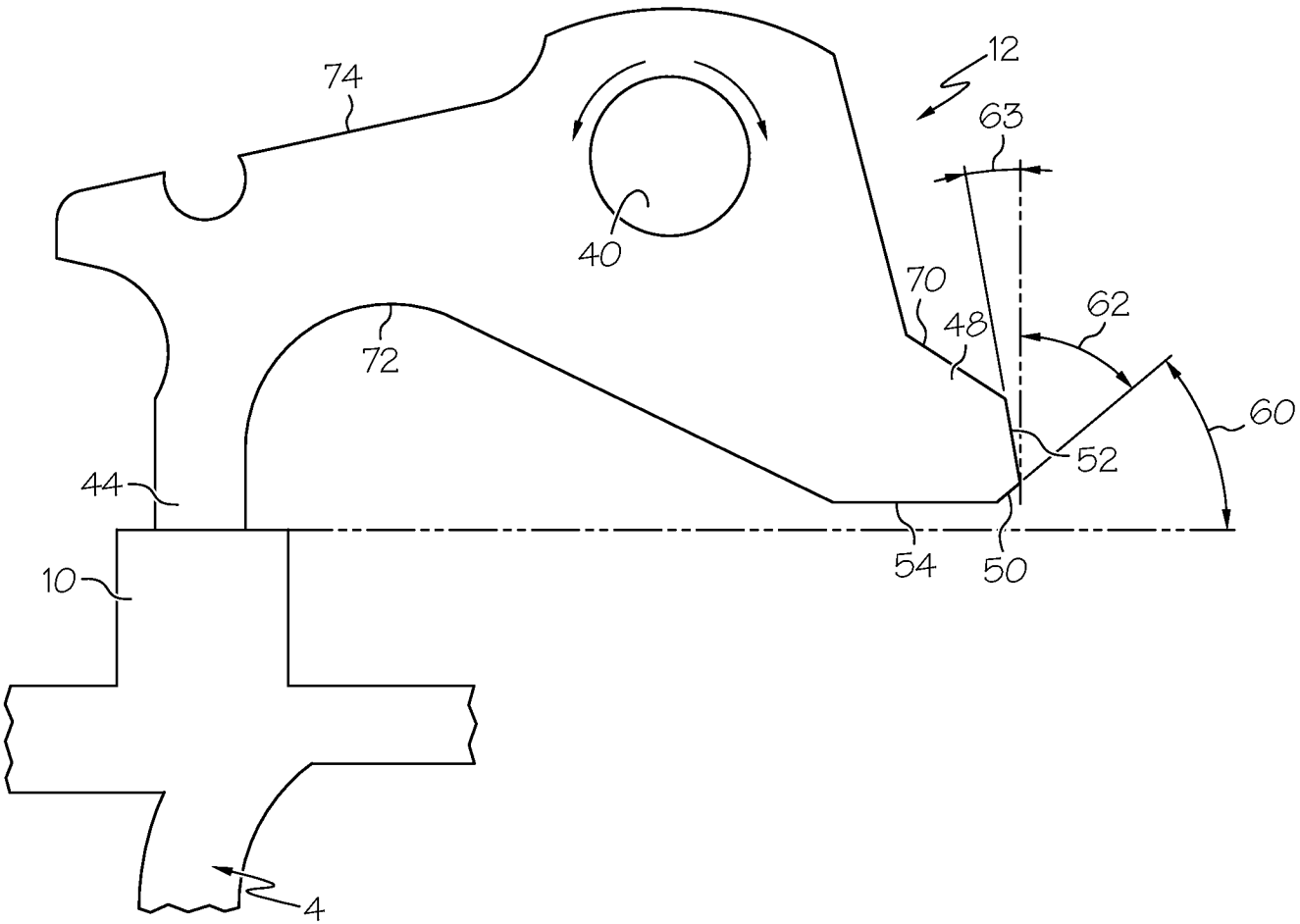
FIG. 4 is an enlarged side view of the sear.

As shown in FIG. 4, sear 12 includes a body that defines an opening 40 that receives a sear pin 42 that pivotably mounts sear 12 (and its sister sear on the other side of trigger assembly 2) to the body or base frame of the trigger assembly. Sear 12 includes a foot 44 offset laterally on one side of opening 40. Foot 44 is configured to be engaged by lifting block 10 of trigger 4 when trigger 4 is pulled rearwardly. In some configurations, the bottom surface of foot 44 defines the lowermost surface of sear 12 when the bottom surface of foot 44 is disposed horizontal.

Sear 12 also includes a block portion 48 offset laterally on the other side of opening 40 from foot 44 such that opening 40 is disposed intermediate foot 44 and block portion 48. Block portion 48 of sear 12 defines first 50 and second 52 catch surfaces that are sequentially engaged by striker catch 14 during the process of firing the gun. Second catch surface 52 is disposed adjacent to and above first catch surface 50 when the gun is held in its normal firing position. In this context, the term adjacent is not limited to a narrow definition such as immediately adjacent as there may be a short transition surface or surfaces joining the two surfaces. Also, the term "above" is not intended to be limited to any particular direction but instead is intended to refer to the direction relevant to first surface 50 in which the striker catch is positioned when the trigger is pulled back. In the exemplary configuration depicted in FIG. 4, the lower surface 54 of block portion 48 is disposed above the lower surface of foot 44 when the bottom surface of foot 44 is disposed horizontal. First catch surface 50 is angled upwardly and away from lower surface 54 (when lower surface 54 is disposed horizontal) with second surface 52 extending upwardly from the top of first surface 50. In the exemplary configuration, second surface 52 extends upwardly and tilted in a direction toward opening 40 from vertical when trigger assembly 2 is in the home position depicted in FIG. 1. The particular arrangements of surfaces 50 and 52 are tuned to match the particular trigger configuration where sear 12 is to be installed.

In the exemplary configuration of the invention, first surface 50 is 0.59 mm to 0.74 mm in length and is disposed at an angle of 29 to 40 degrees (reference angle 60) with respect to lower surface 54. Second surface 52 is 0.59 mm to 0.84 mm in length and is disposed at a +10 or −10 degree angle (reference angle 63) to vertical. Reference angle 62 is 50 degrees to 61 degrees. These specific dimensions are critical for one configuration of the Blazer F3 trigger. The exact dimensions and angles of sear 12 are configured for the particular trigger that is receiving sear 12. The exact lengths and angles of sear 12 depends on the exact distances between the pivot pins that hold the trigger together and these vary from trigger to trigger even in triggers used with the same model gun.

Sear 12 also defines an upper surface 70 of block portion 48 that extends toward opening 40 away from the upper end of second surface 52. Foot 44 is connected to one end of lower surface 54 with an arched bottom surface 72. The top surface 74 of sear 12 is elongated and smooth and configured to be engaged by sear catch 18.

Figure 2:
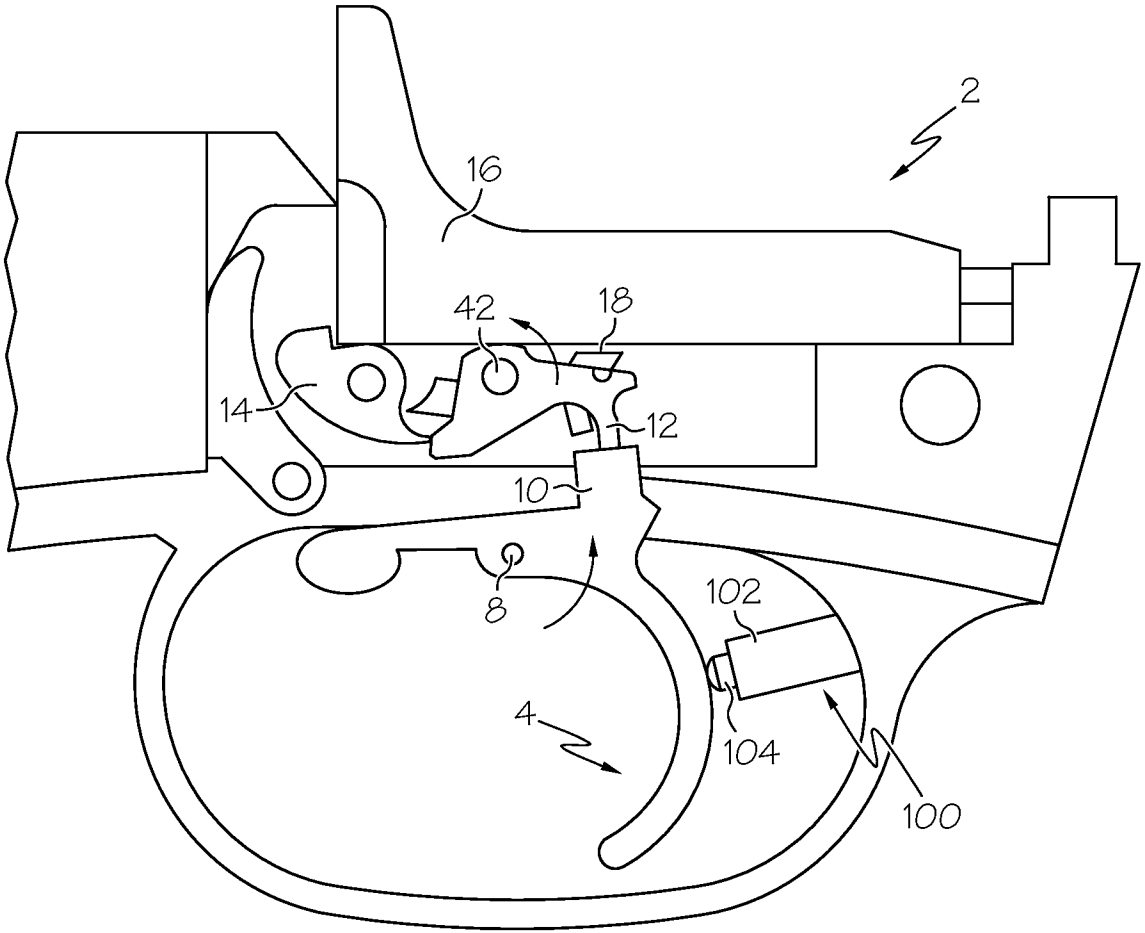
FIG. 2 is a side view of the trigger assembly showing the set position wherein the sear is holding the striker catch.
Figure 3:
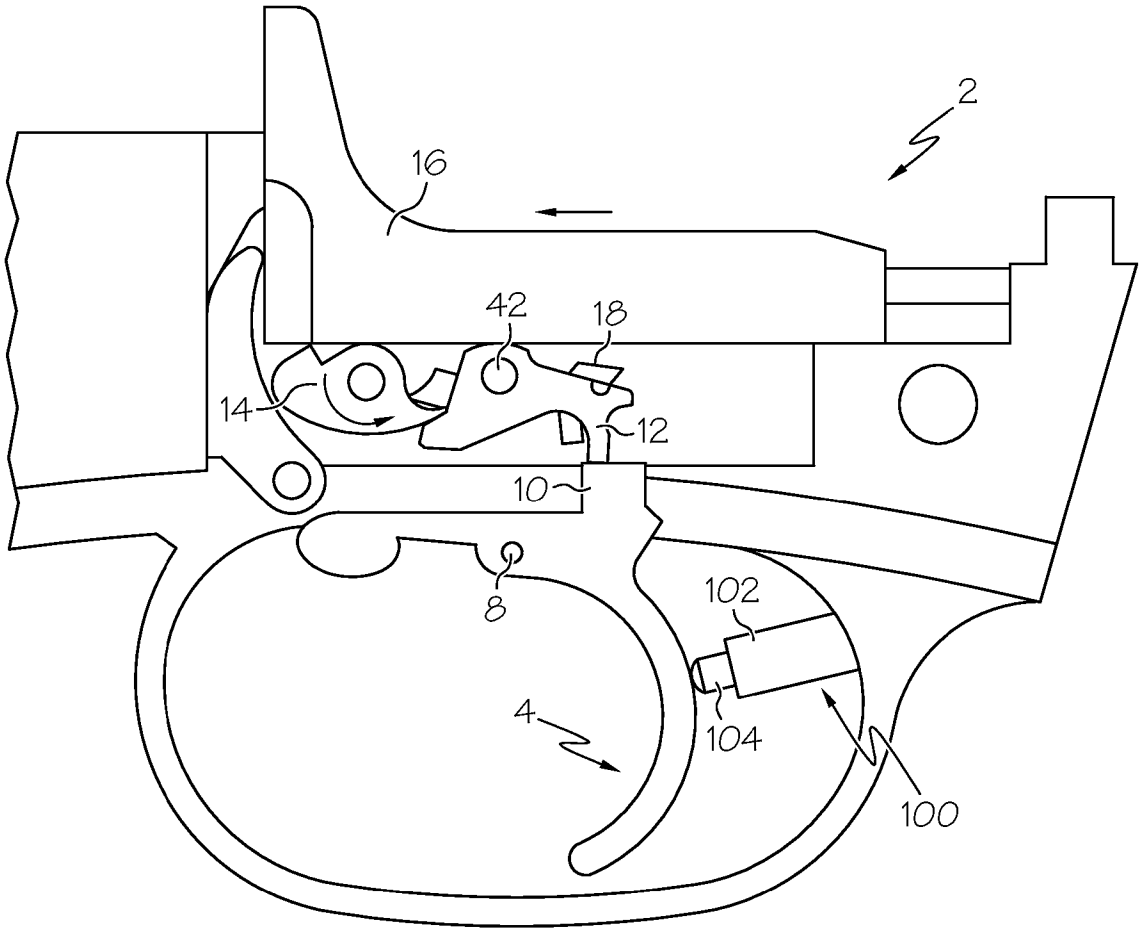
FIG. 3 is a side view of the trigger assembly showing the fired position of the trigger and the striker catch.

In operation, trigger assembly 2 is disposed in the home position when the gun is ready to be fired. In the home position, trigger 4 is forward and striker catch 14 is engaged with first catch surface 50 of block portion 48 of sear 12. Striker 16 is exerting a holding force on sear catch 14 which, in turn, is forcing sear 12 down against lifting block 10 of trigger 4. This force urges sear 12 in the clockwise direction of FIGS. 1-3. When trigger 4 is pulled back (to the right in FIG. 1), lifting block 10 is moved upwardly to push against foot 44 upwardly causing sear 12 to rotate counterclockwise as shown in FIG. 2. This movement causes sear catch 14 to move off of first catch surface 50 and onto second catch surface 52 as seen by comparing FIGS. 1 and 2. Note that this is where the prior art sear (one that does not include second surface 52) used with a pull trigger immediately released striker catch 14 and thus allowed striker 16 to fire the gun. With sear 12 having second catch surface 52, striker catch 14 is held in place by second surface 52 thus placing trigger assembly 2 in the set position. The force imparted on sear catch 14 from striker 16 imparts a counterclockwise rotational force on sear 12 by pressing against second surface 52. This force is countered by sear catch 18. Sear catch 18 engages the upper surface of sear 12 and transfers the holding force of trigger 4 to sear 12. The force holding trigger 4 rearwardly is supplied by the user. When the user releases the force on trigger 4, the sear catch 18 is released and sear 12 immediately rotates counterclockwise (FIG. 3) to release striker catch 14 from second surface 52. Striker catch 14 rotates over the top of block portion 48 to release striker 16. Striker 16 then moves forward to strike the firing pin of the gun. The force of the shell explosion forces a cocking rod (not shown) to move the cocking arm to reset striker 16 which allows sear 12 and striker catch 14 to reset.

Figure 5:
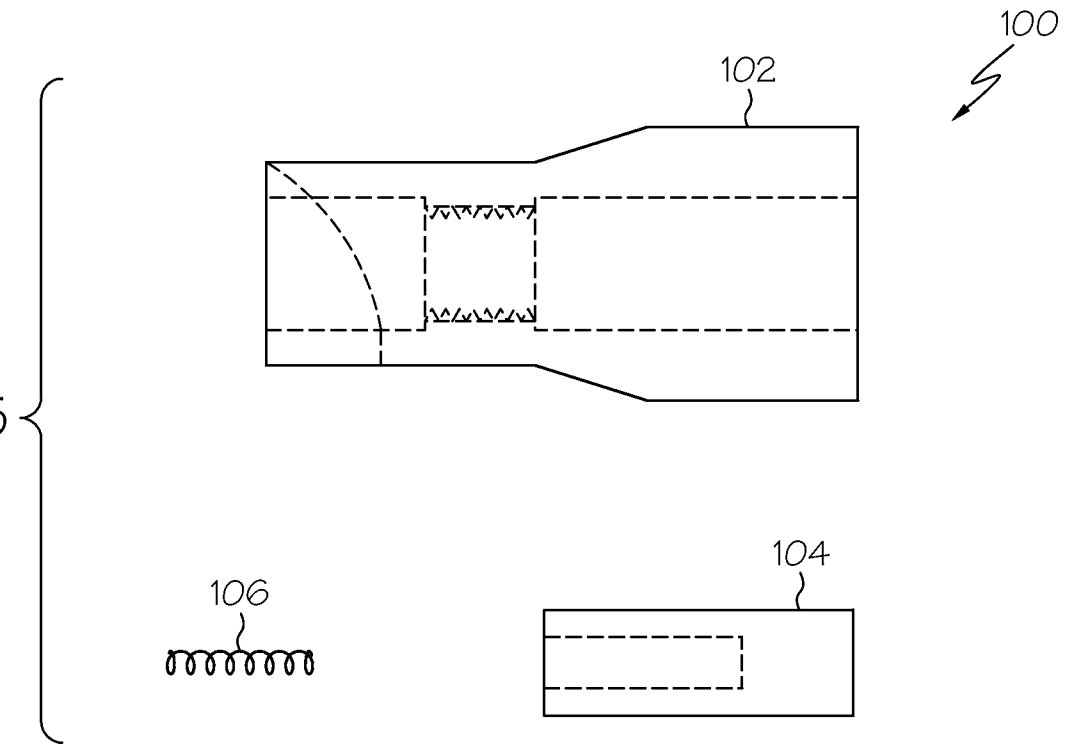
FIG. 5 is a side view of the parts of a pressure adjustment assembly.

FIG. 5 depicts an exemplary configuration of the parts of a pressure adjustment assembly 100 that is optionally carried by trigger guard 6 behind trigger 4. Pressure adjustment assembly 100 includes a base 102 and an adjustable plunger 104 that is biased forward by a plunger spring 106. Trigger 4 engages plunger 104 when trigger 4 is pulled back. The force of plunger spring 106 must also be overcome by the person pulling back on trigger. When trigger 4 is released, plunger spring 106 helps to urge trigger 4 forward thus allowing the release pressure to be adjusted to the preference of the shooter. The position of plunger 104 may be adjusted by rotatably threading plunger 104 with respect to base 102.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

We claim:

1. A sear for converting a pull trigger for a shotgun into a release trigger; wherein the sear comprises: a body that defines a first catch surface disposed adjacent to and below a second catch surface; the second catch surface extending upwardly directly from the first catch surface; the first catch surface being adapted to hold a striker catch before the trigger is pulled back and the second catch surface being adapted to hold the striker catch until the holding pressure on the trigger is released.

2. The sear of claim 1, wherein the second catch surface is longer than the first catch surface.

3. The sear of claim 2, wherein the second catch surface is up to 1.42 times longer than the first catch surface.

4. The sear of claim 1, wherein the sear includes a foot and an opening for a sear pin disposed intermediate the foot and the catch surfaces.

5. The sear of claim 4, wherein the sear defines an arched bottom surface disposed intermediate the foot and the first catch surface; the arched bottom surface being arched into the body of the sear toward the pivot pin opening.

6. The sear of claim 5, wherein the sear defines a flat lower surface disposed intermediate the arched bottom surface and the first catch surface.

7. The sear of claim 1, wherein the first catch surface has a length of between about 0.59 millimeters to 0.74 millimeters.

8. The sear of claim 7, wherein the second catch surface has a length of between about 0.59 mm to 0.84 mm in length.

9. A method for converting a pull trigger to a release trigger wherein the pull trigger includes a rear lifting block; a pull trigger sear independent from the pull trigger; the pull trigger sear being engaged by the rear lifting block when the trigger is pulled rearwardly; a striker catch engaging a first catch surface of the pull trigger sear; the striker catch retaining a biased striker that is used to drive a firing pin into a primer; the method comprising the step of:

replacing the pull trigger sear with a release trigger sear that has a second catch surface disposed adjacent and extending directly from a first catch surface; the striker catch being adapted to engage the second catch surface of the release trigger sear to prevent the striker from being released until the trigger is released by the user; the pull trigger sear being replaced without replacing the pull trigger.

10. A release trigger assembly for a shotgun having a trigger with a rear lifting block; a sear that is engaged by the rear lifting block when the trigger is pulled rearwardly; a striker catch engaging a first catch surface of the sear; the striker catch retaining a biased striker that is used to drive a firing pin into a primer; wherein the improvement comprises:

a second catch surface disposed adjacent and extending directly from the first catch surface on the sear of the release trigger; the striker catch engaging the second catch surface of the sear to prevent the striker from being released until the trigger is released by the user.

11. The improvement of claim 10, wherein the second catch surface of the sear is disposed above the first catch surface of the sear.

12. The improvement of claim 11, wherein the second catch surface is angled forwardly from about 45 to 75 degrees from the first catch surface.

13. The improvement of claim 10, wherein the second catch surface is longer than the first catch surface.

14. The improvement of claim 13, wherein the second catch surface is up to 1.42 times longer than the first catch surface.

15. The improvement of claim 10, further comprising a pressure adjustment assembly disposed behind the trigger.

16. The improvement of claim 10, wherein the sear includes a foot that is engaged by the rear lifting block; the sear defining a pivot pin opening disposed intermediate the second catch surface and the foot.

17. The improvement of claim 16, wherein the sear defines an arched bottom surface disposed intermediate the foot and the first catch surface; the arched bottom surface being arched into the body of the sear toward the pivot pin opening.

18. The improvement of claim 17, wherein the sear defines a flat lower surface disposed intermediate the arched bottom surface and the first catch surface.

19. The improvement of claim 10, wherein the first catch surface has a length of between about 0.59 millimeters to 0.74 millimeters.

20. The improvement of claim 19, wherein the second catch surface has a length of between about 0.59 mm to 0.84 mm in length.

* * * * *